United States Patent [19]

Villafana

[11] 4,083,582

[45] Apr. 11, 1978

[54] BOOK PROTECTOR

[76] Inventor: Jesus Mario Aguirre Villafana, P.O. Box SUC J No. 4501, Monterrey, Mexico

[21] Appl. No.: 757,980

[22] Filed: Jan. 10, 1977

[51] Int. Cl.[2] ..... B42D 3/10

[52] U.S. Cl. ..... 281/20; 24/205.16 D; 281/29

[58] Field of Search ..... 24/2, 205.16 R, 205.16 D; 150/1.6; 190/41 Z; 281/15 R, 20, 29, 37, 34, 31

[56] References Cited

U.S. PATENT DOCUMENTS

| | | | |
|---|---|---|---|
| 91,570 | 6/1869 | Sewell | 281/20 |
| 2,390,958 | 12/1945 | Perlin | 281/31 |
| 2,701,222 | 2/1955 | Hetzel | 24/205.16 D X |
| 2,742,070 | 4/1956 | Jones | 281/34 X |
| 3,685,103 | 8/1972 | Severino | 24/205.16 D |
| 3,785,014 | 1/1974 | Canepa | 24/205.16 D |

FOREIGN PATENT DOCUMENTS

| | | | |
|---|---|---|---|
| 690,550 | 4/1953 | United Kingdom | 281/20 |

OTHER PUBLICATIONS

"Childrens Bibles", p. 175 of Morehouse-Barlow 1961 General Catalog.

*Primary Examiner*—Harland S. Skogquist

[57] ABSTRACT

This invention relates to a device for protecting the edges of a book. An elongated, flexible material has a zipper located along the center of the elongated axis. The zipper, which may be of the plastic pressure lock type, connects two elongated halves forming the flexible material. On the outer edges of the flexible material is an adhesive bonding surface protected by an adhesive covering strip. In use, the adhesive covering strip is removed. The flexible material is then attached to the outer edges of the book by the adhesive bonding surface. To open the book, the zipper is unzipped, thereby allowing the book to be opened. To provide smooth corners on the book, notches are cut in the flexible material.

1 Claim, 6 Drawing Figures

BOOK PROTECTOR

BACKGROUND OF THE INVENTION

The present invention relates to a protector for books and, more particularly, to a protective cover that may be attached to the edges of the book to protect the edges against normal wear and tear.

BRIEF DESCRIPTION OF THE PRIOR ART

Prior to the present invention, numerous types of book covers have been devised. The most typical book cover was made out of a flat sheet of paper or plastic that was folded about the back and front of the book. The book cover may be attached inside of the back and front of the book. However, this type of book cover provided no protection for the edges of the pages. If the book was dropped while being carried from one location to another, the book would open with possible damage resulting to individual pages.

Other types of book covers simply wrapped around the entire book. The entire cover had to be removed prior to opening the book. For more expensive books, such as the family Bible, it was common to have a zipper sewn to the back and front of the book whereby upon opening the book, the zipper is unzipped; however, upon closing the book, the zipper may be zipped to thereby protect the edges of the book. Only the more expensive books, such as the family Bible, had the zipper sewn to the covers. For less expensive books, the edges were normally exposed to the elements during everyday usage.

SUMMARY OF THE INVENTION

In the present invention, an elongated, flexible material (which may be of cloth, plastic, or other suitable material) has a zipper sewn along the center elongated axis thereby dividing the material in two separate halves. On the outer edge of each half is an adhesive bonding surface that is protected by an adhesive covering strip prior to attachment of the protective cover to the edges of the book. The zipper may be of the standard metal locking type or a pressure lock plastic type. After removal of the adhesive covering strip, the edges of the flexible material are bonded to the outer edges of the book. To eliminate overlap at the corners of the book, a notch may be cut in the flexible material. By unzipping the zipper, the book may be opened for normal use; however, upon completion of normal use, the book may be closed and the zipper zipped closed to protect the edges of the book during periods of nonuse.

DESCRIPTION OF THE PREFERRED EMBODIMENT

Figure 1:
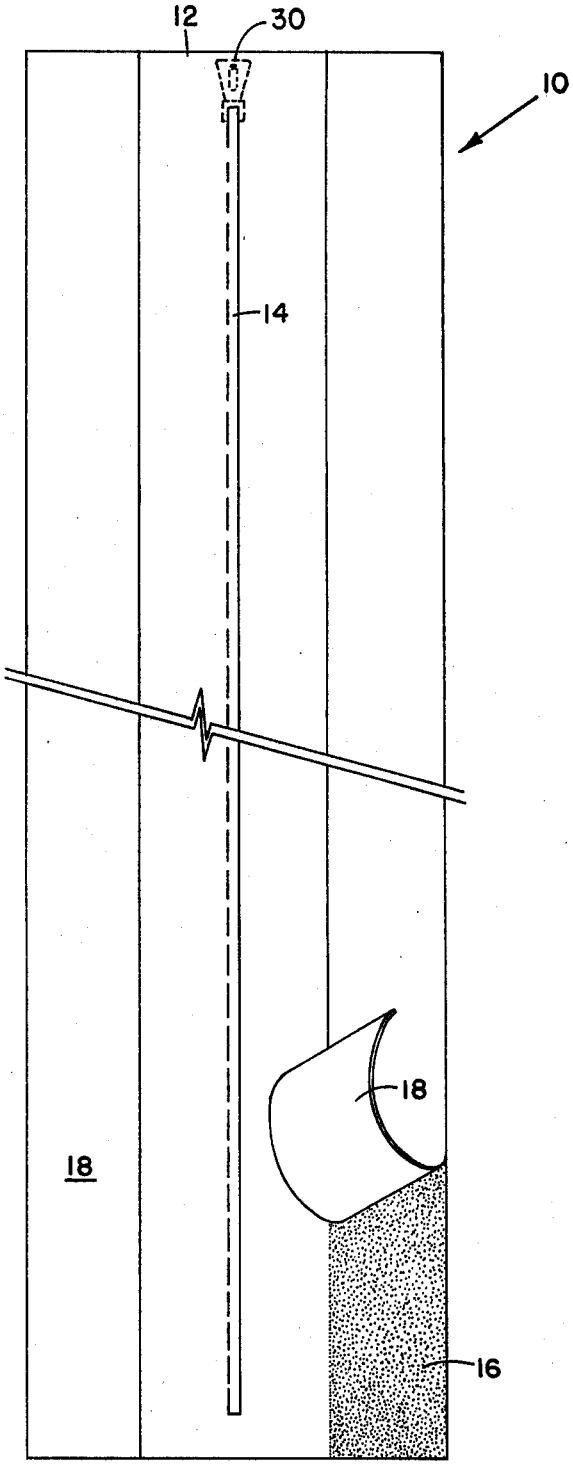
FIG. 1 is an elevated view of the protective cover prior to attachment to a book with the adhesive covering strip being partially removed.
Figure 5:
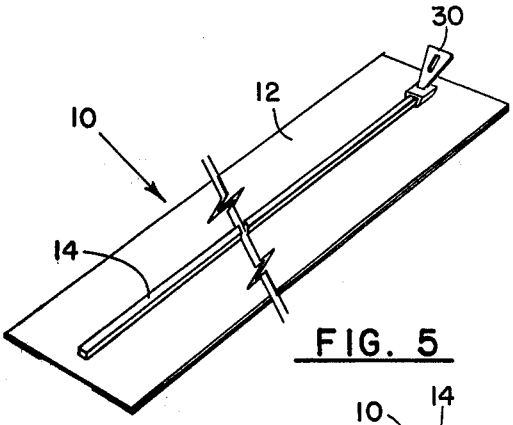
FIG. 5 is a perspective view of the protective cover.
Figure 2:
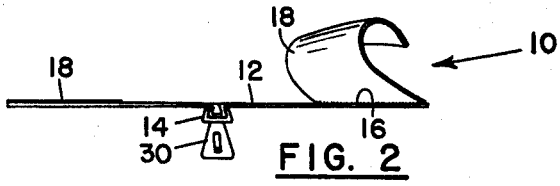
FIG. 2 is an end view of FIG. 1.

Referring now to FIGS. 1, 2 and 5 in combination, there is shown a protective cover represented generally by the reference numeral 10. The protective cover 10 consists of an elongated sheet of flexible material 12 that is divided into two separate halves along the elongated axis by zipper 14. The flexible material may be of any suitable substance, such as a flexible plastic or cloth. All that is required is that the flexible material have sufficient strength for normal usage, and the desired flexibility for protective cover 10 to be used on a book. The zipper 14 may be of the standard metal type interwoven in a cloth strip, or the zipper 14 could be of the plastic pressure lock type.

It is only necessary that the flexible material 12 be wide enough to cover the edge of the closed book and overlap a small portion of the outer covers. Along the outer edges of the flexible material 12 is an adhesive bonding surface 16 that is protected prior to attachment to a book by adhesive bonding strip 18.

Figure 3:
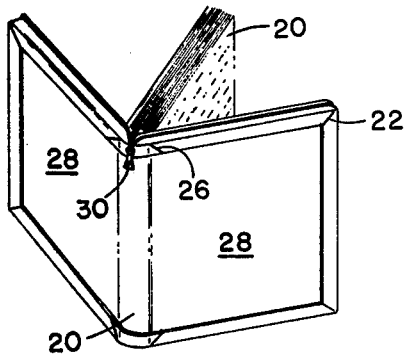
FIG. 3 is a perspective view of the book cover attached to an open book.
Figure 4:
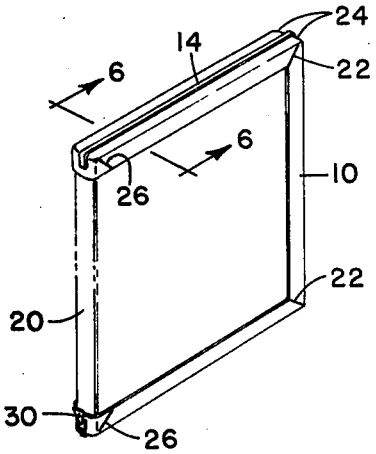
FIG. 4 is a perspective view of the book cover attached to a closed book.
Figure 6:
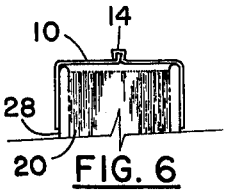
FIG. 6 is a partial cross sectional view of FIG. 4 along section lines 6—6.

Immediately prior to attaching the protective cover 10 to a book, the adhesive bonding strip 18 is removed from both sides of the flexible material 12. Referring to FIG. 4, with the zipper 14 closed, the protective cover 10 is attached to the outer edges of the covers 28 of book 20 by the adhesive bonding surface 16. Notches 22 are cut in the flexible material 12 to prevent an overlap of a flexible material 12 at the corners 24 of the book 20. Also, notches 26 are cut in the flexible material 12 at the upper and lower attachment points of the binding of the book 20. The notches 22 and 26, which may be cut either before or after the attachment of the protective cover 10 to the book 20, prevent an overlap of the flexible material 12. The attachment of the protective cover 10 to the covers 28 of the book 20 can be more clearly seen in the partial cross sectional view of FIG. 6. To open the book 20 for normal reading purposes, an individual would pull the zipper fastener 30 to open the zipper 14. Thereafter, the book 20 could be opened as shown in FIG. 3. Conversely, the book 20 could be closed and the zipper closed by moving the zipper fastener 30 around the edge of the book 20 to the position previously shown in FIG. 4.

By use of the protective cover 10, the edges of the book 20 may be protected from normal wear and tear. While zippers have been shown in the prior art to be permanently attached to the covers of more expensive books, the present invention provides an inexpensive protective cover that may be used in the protection of the edges of less expensive books. Further, the protective cover 10 may be used in combination with flat sheets of material normally used to protect the outer surface of hard covers. Once the flat sheet of material is folded over the hard surface of the covers, the protective cover 10 may be attached thereto for protection of the edges of the book. By use of the proper adhesive bonding surface 16, the protective cover 10 may be removed from one book and placed upon another book of the similar size. The lengths of the protective cover 10 may be varied according to the dimensions of the particular book being covered.

I claim:

1. A protective cover for a book comprising:

an elongated, flat generally rectangular, flexible sheet material having first and second flat surfaces;

zipper means located approximately along a center elongated axis of said flexible sheet material, said zipper means dividing said flexible sheet material into two approximately equal halves;

said zipper means having a zipper fastener on the first of said flat surfaces for opening the zipper means;

at least two notches in each of the halves to allow each halve of the sheet material to be edgewise folded around a corner of a book cover to prevent overlap of the sheet material;

adhesive bonding surface afixed along the second of said flat surfaces adjacent each outer elongated edge of said flexible material, said adhesive bonding surfaces being adapted for attachment to outer edges of a cover of said book; and an adhesive covering strip removably attached to said adhesive bonding surface for covering said adhesive bonding surface prior to attachment to said book.

* * * * *